US011788277B2

(12) United States Patent
Uusalu

(10) Patent No.: US 11,788,277 B2
(45) Date of Patent: Oct. 17, 2023

(54) RUPTURE ELEMENT IN CONCRETE STRUCTURES

(71) Applicant: WPMESTONIA OÜ, Tallinn (EE)

(72) Inventor: Indrek Uusalu, Tallinn (EE)

(73) Assignee: PRIMOSTAR TOOTMINE OÜ, Tallinn (EE)

( * ) Notice: Subject to any disclaimer, the term of this patent is extended or adjusted under 35 U.S.C. 154(b) by 33 days.

(21) Appl. No.: 17/601,207

(22) PCT Filed: Jan. 23, 2020

(86) PCT No.: PCT/IB2020/050514
§ 371 (c)(1),
(2) Date: Oct. 4, 2021

(87) PCT Pub. No.: WO2020/201840
PCT Pub. Date: Oct. 8, 2020

(65) Prior Publication Data

US 2022/0178136 A1 Jun. 9, 2022

(30) Foreign Application Priority Data

Apr. 5, 2019 (EE) ..... P201900010

(51) Int. Cl.
*E04B 1/68* (2006.01)
*E04B 1/00* (2006.01)
*E04B 1/24* (2006.01)

(52) U.S. Cl.
CPC ..... *E04B 1/6806* (2013.01); *E04B 1/0007* (2013.01); *E04B 2001/2481* (2013.01)

(58) Field of Classification Search
CPC ..... E01C 11/02; E02D 5/14; E04F 5/14
USPC ..... 52/434, 418, 223.7, 223.13, 253, 715, 52/712, 601
See application file for complete search history.

(56) References Cited

U.S. PATENT DOCUMENTS 3,871,787 A * 3/1975 Stegmeier ..... E04B 1/6804 52/396.02
4,745,716 A * 5/1988 Kuypers ..... E04F 17/00 52/302.3
5,910,087 A * 6/1999 Carter ..... E01C 11/106 52/367
5,918,428 A * 7/1999 Hough ..... E04B 1/68 404/55

(Continued)

FOREIGN PATENT DOCUMENTS

DE 20 2010 016481 U1 4/2011
EP 3 093 412 A1 11/2016
EP 3093412 A1 * 11/2016 ..... E04C 5/16

OTHER PUBLICATIONS

Machine Translation of EP3093412 (Year: 2016).*

(Continued)

*Primary Examiner* — Jessica L Laux
(74) *Attorney, Agent, or Firm* — Meunier Carlin & Curfman LLC

(57) ABSTRACT

The invention relates to a rupture element, which is located in concrete structures and the rupture element comprises a sheet material with edges that are bent at an angle so that they produce a tenon-shape. The rupture element, if necessary, is waterproof and produces slightly weakened cracks in the predefined location of concrete.

10 Claims, 1 Drawing Sheet

(56) References Cited

U.S. PATENT DOCUMENTS

| | | | | |
|---|---|---|---|---|
| 5,956,912 | A * | 9/1999 | Carter | E01C 11/106 52/367 |
| 6,668,506 | B2 * | 12/2003 | Snauwaert | E01C 5/08 52/715 |
| 10,047,515 | B2 * | 8/2018 | King | E04C 5/16 |
| 2003/0140590 | A1 * | 7/2003 | Lancelot | E04B 5/023 52/712 |
| 2007/0056242 | A1 * | 3/2007 | Sample | E04B 1/41 52/698 |
| 2012/0192506 | A1 * | 8/2012 | King | E04B 1/043 52/125.4 |

OTHER PUBLICATIONS

PCT/IB2020/050514, International Search Report dated Apr. 7, 2020, 2 pages.

Dynahurst-Crack Inducers web page printout (www.dynahurst.com/reinforcement-accessories/crack-inducers/); printed Sep. 30, 2021.

WPF Waterproofing for Professionals web page printout from Wayback Machine (https://web.archive.org/web/20180904053921 /https:/wfp-waterproofing.de/en/products/rapture-elements/); printed Oct. 4, 2021.

* cited by examiner

RUPTURE ELEMENT IN CONCRETE STRUCTURES

CROSS-REFERENCE TO RELATED APPLICATIONS

This is a U.S. national application of the international application number PCT/IB2020/050514 filed on Jan. 23, 2020 and claiming priority of Estonian patent application P201900010 filed on Apr. 5, 2019, the contents of both of which are incorporated herein by reference.

TECHNICAL FIELD

The invention belongs in the field of construction, specifically the invention relates to a rupture element of sheet material, intended for creating predetermined cracks in concrete structures.

PRIOR ART

Known is a crack inducer plate for concrete (U.S. Pat. No. 5,918,428, Engineered Devices Corporation, published 6 Jul. 1999). The invention relates to a device and method for creating predetermined (controlled) cracks in concrete to avoid occurrence of undesired cracks in concrete structures. The plate assembly includes a core plate, where the opposite sides and the inner edge (blade) are covered with a waterproof and resilient waterstop member made, for example, of PVC plastic. The waterstop is fixed to the core plate, for example by silicone adhesive, waterproof sealant or adhesive. The waterproof and resilient waterstop controls (guides) the formation of cracks in the concrete, avoiding the occurrence of similar cracks in the outer surface of the concrete and controlling that the location and shape of the crack was straight.

Cross-plates are welded to the core plate in order to attach it to the reinforcing rods of the concrete. A disadvantage of this invention is the complexity of structures, also that the solution creates only vertical watertight cracks in a desired location in the concrete, without transferring the strength of its cross-section.

Known are PVC crack inducers (http://www.dynahurst-.com/reinforcement-accessories/crack-inducers/) used for creating controlled cracks in specific places in concrete slabs. A two-piece or a one-piece crack inducer is installed in a wet concrete slab to form a controlled crack. A disadvantage of this solution is that it can only be used in a horizontal surface. Furthermore, the crack inducers must be installed after casting, making the time of their installation especially complex. The solution is also unsuitable for load-bearing structures.

Known is the WFP GmbH WFP Rupture Element SFR 125 (https://wfp-waterproofing.de/en/products/rapture-elements), which consists of a straight steel element coated or uncoated with rubber bitumen on both sides, and a holding element fixed in the middle at a 90 degree angle. This solution is used for creating vertical cracks in monolithic walls and involves no transfer of strength.

Closest to the present invention by its technical nature is the WFP GmbH rupture element SFG (https://wfp-waterproofing.de/en/products/rapture-elements), which includes a straight steel element coated or uncoated with rubber bitumen on both sides, and an element with a right angle profile attached on top of it. This solution is used for sealing triple-layer wall elements in the corners of straight joints to achieve a water-tight diagonal breaking point. The solution creates cracks in vertical surfaces, but does not transfer strength.

SUMMARY OF THE INVENTION

A problem involved in casting concrete walls, floors and ceilings is that large surfaces cannot be cast all at once due to the shrinking of concrete, which results in cracks caused by volume shrinking. In underground parts of a building, water penetrates these cracks, which damages concrete structures.

In order to eliminate this problem, a rupture element is presented, which is an element of sheet material installed into concrete structures, creating controlled cracks (at preset locations), which are watertight if necessary, and cause only minor weakening of the cross-section of the concrete structure.

The rupture element includes a sheet of sheet material to which an L-profile element of sheet material is attached on top and underneath, and where the sections perpendicular to the sheet have edges (borders), while the edges (borders) are bent at such an angle as to form a tenon-shaped cross-section. The rupture element can also be used as a joint between different concrete castings. When the rupture element is used in a structure exposed to water, the sheet of the sheet material of the rupture element is supplied optionally with a special watertight bonding material of mineral or organic (e.g. bitumen) or artificial material/binder applied on one or the other side. The sheet of the sheet material and the element with the right angle profile of sheet material are preferably produced from sheet metal, specifically sheet steel, but other materials such as RST, Zn, rubber, plastic or certain carbon material, etc. can also be used.

EMBODIMENT OF THE INVENTION

Figure 1:
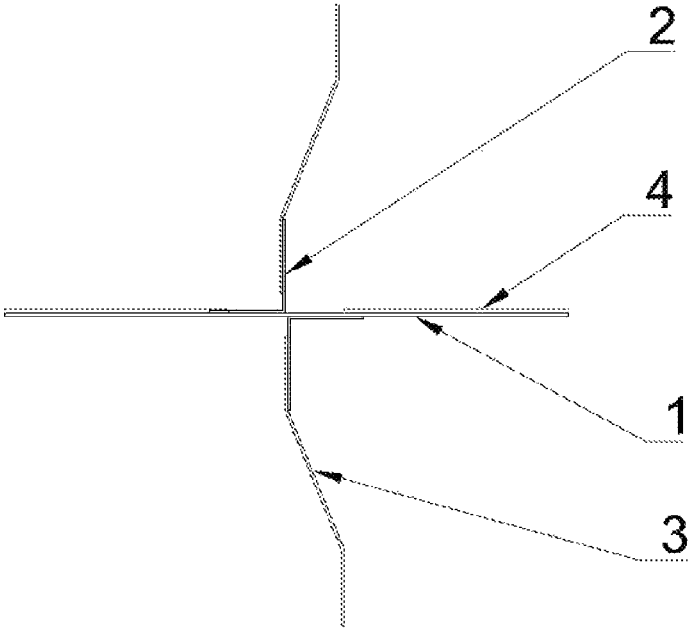
FIG. 1 shows a preferred embodiment of the rupture element of sheet material, where the sides are bent at 22.5 degree angle.
Figure 2:
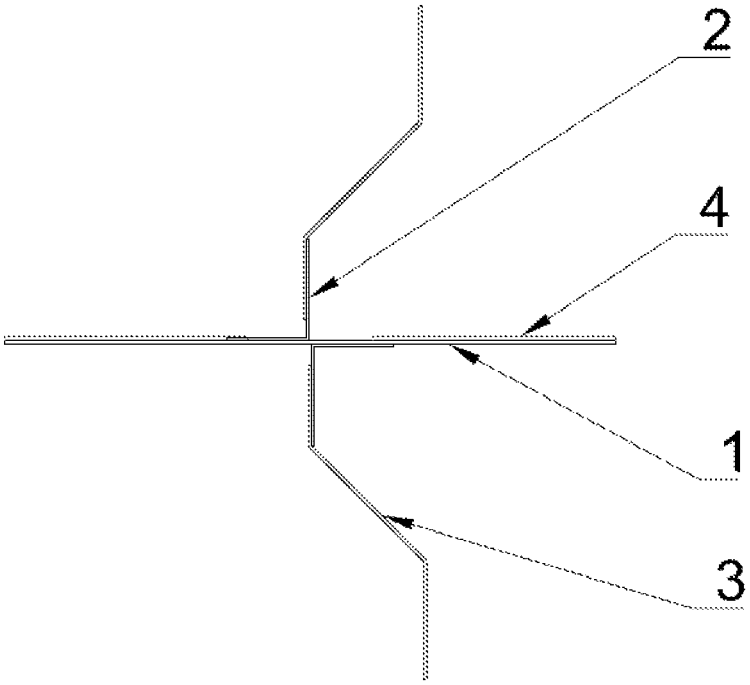
FIG. 2 shows a preferred embodiment of the rupture element of sheet material, where the sides are bent at 45 degree angle.

The rupture element comprises sheet 1 of sheet material, where sheet elements 2 with right angle profile and edges (borders) 3 are welded centrally on both sides of sheet 1. The edges 3 are bent at an angle from 1 to 179 degrees, forming a tenon-shaped cross-section to the crack created and thereby retaining the strength properties of the concrete structure. The preferable angle is 20 to 25 degrees, most preferably 22 degrees or 40 to 50 degrees, most preferably 45 degrees. The sheet (1) of the sheet material and the element (2) with right angle profile are preferably produced from sheet metal, specifically from sheet steel.

The rupture element is installed to the surface to be cast prior to casting the concrete surface, followed by uninterrupted casting of the concrete structure or slab (floor, ceiling, wall) of any size. The sheet elements 2 of the rupture element create joints in the concrete structure, determining the areas, where cracks will be forming in the concrete. The elements 2 folded at an angle provide the crack with a tenon-shaped cross-section, which will retain the strength of the concrete structure. The rupture element is installed in the center of the concrete structure, between reinforcements.

The rupture element creates immediately controlled cracks in the concrete. The rupture elements are mechanically joined together by means of screws for sheet metal or special clamps.

When the rupture element is used underground or otherwise in a structure exposed to water, a special watertight bonding material 4 is applied on one or both sides of the rupture element sheet 1, to bond with the concrete around and thereby prevent penetration of water between the rupture element sheet 1 and concrete, and ensuring thereby the waterproofness (water-tightness) of the created crack. The bonding material can be a material/binder produced from a mineral or organic (e.g. bitumen) or artificial material/substance. Tests have shown that in hardened concrete the material is watertight at up to 2.5 bar.

If the rupture element is used on the ground or in places where it is not exposed to water (e.g. ceilings, walls above ground) then it is not necessary to cover the rupture element sheet 1 with the bonding material 4.

ADVANTAGES OF THE INVENTION

- the rupture element creates joints in concrete structures (cast concrete) in a controlled manner and determines the positions where cracks will occur in the concrete, whereas waterproofness (water-tightness) of the element and its joints is ensured as needed, whereas it has only a minor weakening effect on the cross-section of the concrete;
- using the rupture element as a joint allows casting large concrete structures (or surfaces, e.g. the whole floor or ceiling or wall) all at once;
- time-saving in concrete work and later preserving of the quality of the concrete structure as well as savings gained from the use of reinforcements in the concrete work are substantial.

The invention claimed is:

1. A rupture element configured to produce controlled cracks in a predefined location of a concrete structures, comprising a sheet of sheet material, and two L-shaped sheet elements, each having a first and a second leg in a right angle, wherein the first leg of each sheet element is welded onto an opposite side of the sheet such that the right angles of the sheet elements face each other and ends of the first legs point to opposite directions, and the second legs of each of the sheet elements have a bottom-, a middle- and an end-section, wherein the bottom and the end sections of the second legs point perpendicularly away from the sheet and the middle sections in each sheet element are bent to same direction parallel to the first leg such that an equal angle is formed in each sheet element between the bottom section and the middle section and between the middle section and the end section.

2. The rupture element according to claim 1, wherein the angle is from 1 to 179 degrees.

3. The rupture element according to claim 2, wherein the angle is from 20 to 25 degrees.

4. The rupture element according to claim 2, wherein the angle is from 40 to 50 degrees.

5. The rupture element according to claim 3, wherein the angle is a 22-degree angle.

6. The rupture element according to claim 4, wherein the angle is a 45-degree angle.

7. The rupture element according to claim 1, wherein the sheet of sheet material and the sheet element are of sheet metal.

8. The rupture element according to claim 7, wherein the sheet of sheet material and the sheet element are of sheet steel.

9. The rupture element according to claim 1, wherein the sheet of sheet material is coated with a watertight bonding material.

10. The rupture element according to claim 9, wherein the water-tight bonding material of the sheet of sheet material is a mineral or artificial or organic material/binder.

* * * * *